United States Patent [19]

Overall

[11] 4,268,712

[45] May 19, 1981

[54] ELECTRON DISPLAY TUBES

[75] Inventor: Colin D. Overall, Reigate, England

[73] Assignee: U.S. Philips Corporation, New York, N.Y.

[21] Appl. No.: 42,655

[22] Filed: May 25, 1979

[30] Foreign Application Priority Data

May 30, 1978 [GB] United Kingdom ..... 23760/78

[51] Int. Cl.[3] ..... H01J 29/86

[52] U.S. Cl. ..... 174/50.63; 29/25.13; 174/17.08; 220/2.3 A; 313/477 R; 358/246

[58] Field of Search ..... 174/17 CT, 17.05, 17.06, 174/17.08, 50.61, 50.63; 220/2.1 A, 2.3 A; 313/477 R, 477 HC, 478–482, 220, 317, 318; 358/246, 242; 277/101; 29/25.13

[56] References Cited

U.S. PATENT DOCUMENTS 4,121,257 10/1978 Krishnamurthy ..... 220/2.1 A 4,169,274 9/1979 Larson ..... 220/2.1 A

FOREIGN PATENT DOCUMENTS 1482696 8/1977 United Kingdom .

OTHER PUBLICATIONS

Wagner Electric Corporation Advertisement Electrical World, Dec. 4, 1950, p. 52.

*Primary Examiner*—B. A. Reynolds
*Assistant Examiner*—D. A. Tone

[57] ABSTRACT

An electron display tube has its flat glass plate sealed to the flange of its metal cone, or funnel, by the use of a pressure deformable metal strip between the flange and the plate and several U-shaped clamps at the edge of the flange and plate urging the plate and flange towards each other and a metal rimband around the edges of the plate and flange and embracing the clamps so as to maintain them in compression.

12 Claims, 5 Drawing Figures

ELECTRON DISPLAY TUBES

The invention relates to an electron display tube having an envelope comprising a flat, glass face-plate sealed in a vacuum-tight manner to a flange of a metal cone (as hereinafter defined) portion of the envelope by means of a pressure-bonded seal consisting of a pressure-deformable material, and to a method of making and maintaining a vacuum-tight seal between a flat glass face-plate and a flange of a metal cone portion of the envelope of such an electron display tube. The term "cone" is used in this specification to include envelope parts which are not wholly conical in configuration, but are described by this term in the electron display tube art. Such an electron tube may be, for example, a color television display tube.

United Kingdom Pat. No. 1,482,696 provides a method of sealing a glass face-plate in a vacuum-tight manner to the rim of a metal cone of an electron display tube, comprising the steps of providing a malleable metal layer having a melting point in the range of 200° C. to 660° C. between substantially flat facing surfaces of the glass face-plate and the rim of the metal cone, pressing the face-plate and the rim of the metal cone together in a press at a pressure normal to said substantially flat surfaces of between 1 to 5 tons per square inch at a temperature which lies within the range of 150° C. to 450° C. and which is below the melting point of the malleable metal layer at said pressure and below the lowest temperature at which a liquid phase would form at said pressure by interaction of any of the elemental components of the malleable metal layer, metal rim and glass face-plate at the facing surfaces, said pressure and temperature together being applied for a period sufficient to achieve a bond between the glass face-plate and the rim of the metal cone having a bond tensile strength of at least 20% of the Ultimate Tensile Strength of said malleable metal layer.

In some electron display tubes now being developed and using channel plate intensifier structures, for example as described in United Kingdom Pat. No. 1,402,547, the cone may consist of a relatively short mild steel pressing, a typical cone at the face-plate end having a rectangular aperture of 280 mm×210 mm and being 125 mm high. The cone includes a peripheral flange at the face-plate end, to which flange the glass face-plate is sealed. Due to the internal structure of the channel plate intensifier located within the cone, it is desirable to seal the face-plate to the cone at a relatively low temperature which is significantly lower than the temperatures normally used for making glass-to-metal seals.

An object of the invention is to provide an electron display tube having a cheap envelope structure which can be made from readily available starting materials, and which can be assembled to that tube components present in the envelope do not reach such high temperatures as are reached when the seal between the face-plate and cone portion is made using a fusion process with "Pyroceram" (450° C.) or a low melting-point glass solder. Another object of the invention is to make it possible to make large (660 mm) electron display tubes having a pressure-bonded vacuum-tight seal between a flat face-plate and the metal cone portion of the tube, which seal remains vacuum-tight after the tube has been exhausted.

An electron display tube according to the invention is characterized in that the pressure-deformable material consists of copper, silver or gold, or any other suitable material having a melting-point of more than 300° C., at least two lengths in combination of a substantially U-shaped metal channel member having asymmetrically disposed limbs extend around substantially the whole periphery of the face-plate and opposed flange clamping said face-plate and flange, a first limb of said channel member lies along the outside main surface of the face-plate, the seond limb of said channel member diverges from the edge of the face-plate with respect to the first limb and urges the flange of the cone portion by means of a wedging action towards the face-plate, and a metal rimband tightly embraces the lengths of the channel member so as to maintain the pressure-deformable material in compression. The rimband may, for example, be endless, or it may be clamped by screw-thread means, for example, by means of a draw bolt.

The electron display tube according to the invention was developed in order to make an envelope using cheap components, which could be sealed using simple apparatus, and at relatively low temperatures. The flat face-plate may consist for example, of toughened 6 mm thick float glass, and this is significantly cheaper than conventional moulded glass face-plates which require to be ground extensively before use. The metal cone portion of the tube may be, for example mild steel, which has been fluid formed from 1 mm thick sheet.

When an electron display tube having a 6 mm thick float glass face-plate is evacuated, the face-plate is deformed under the influence of the external atmospheric pressure. In the absence of the combination of the channel member and rimband which are used in an electron tube according to the invention, the center of the face-plate of a 320 mm electron display tube would be displaced 1 mm inwards, causing the periphery of the face-plate to rise away from the flange, thus causing the vacuum-tight seal to fail. However, in an electron display tube according to the invention, the rimband acting on the channel member causes the channel member to exert a wedging action clamping the face-plate and flange of the cone portion in position so as to maintain the vacuum-tight seal.

A method of sealing a flat glass face-plate in a vacuum tight-manner to the flange of a metal cone (as hereinbefore defined) portion of an electron tube according to the invention, comprises the steps of locating a loop of pressure-deformable material between substantially flat opposed surfaces of the face-plate and of the flange, pressing the face-plate and the flange towards each other in a press at a temperature which lies within the range of 200° to 450° C. so as to produce a mechanical bond between the face-plate and the flange via the pressure-deformable member which has been deformed by the applied pressure, which temperature is below the melting-point of the pressure-deformable material and below the lowest temperature at which a liquid phase would form during application of the pressure by interaction between the pressure-deformable material and the flange, removing the assembly from the press, fitting at least two lengths of the substantially U-shaped channel member around the periphery of the face-plate and the opposed flange so as to extend around substantially the whole of the said periphery, positioning a metal rimband so as to surround the lengths of the substantially U-shaped channel member, and tightening the rimband so as to tightly embrace the lengths of the channel member and maintain the pressure-deformable material in compression.

When an endless metal rimband is used, the rimband is fitted around the channel member by heating the rimband so as to expand it, positioning it so as to surround the lengths of the channel member, and allowing the rimband to cool and contract so as to tightly embrace the channel member. Such an endless rimband may consist, for example, of a stainless steel, since these materials have coefficients of thermal expansion which expand sufficiently on being heated to about 600° C. to allow the channel member positioned on the assembled envelope to pass within the periphery of the expanded rimband, while the rimband exerts a force on the channel member at the operating temperature of the finished tube which is sufficient to maintain the pressure-deformable material in compression.

The pressure-deformable material may be a malleable metal such as copper, slver, gold or a malleable metal having a melting-point in the range from 300° to 700° C., for example lead, and may be positioned between the face-plate and the flange, for example, as a closed loop of wire or an open loop of wire, the ends of the loop abutting each other. The ends of such an open loop merge to provide a satisfactory seal during thermocompression bonding. The pressure-deformable material may be a polyimide gasket. When the pressure-deformable material is in the form of a gasket, the flange of the metal cone portion may have an integrally formed ridge extending substantially parallel to the periphery of the flange.

The extent of the departure from a symmetrical disposition of the two limbs of the U-shaped channel member may be, for example 10°.

It was found necessary to use at least two lengths of channel member in order that frictional forces should not unacceptably restrict movement of the channel member during contraction of the rimband. When the face-plate is rectangular, it is desirable to use four lengths of the channel member.

It was found that even when the rimband is at 600° C. when it is positioned around the channel member, the temperture of the flange area of the envelope does not rise to 300° C., and inside the envelope the temperature may be below 250° C. The temperature inside the envelope may be reduced, if this is necessary during contraction of the rimband, by passing a gas which does not react with the tube components, for example nitrogen, into the cone portion.

An embodiment of the invention will now be described with reference to the accompanying drawings, in which.

Figure 1:
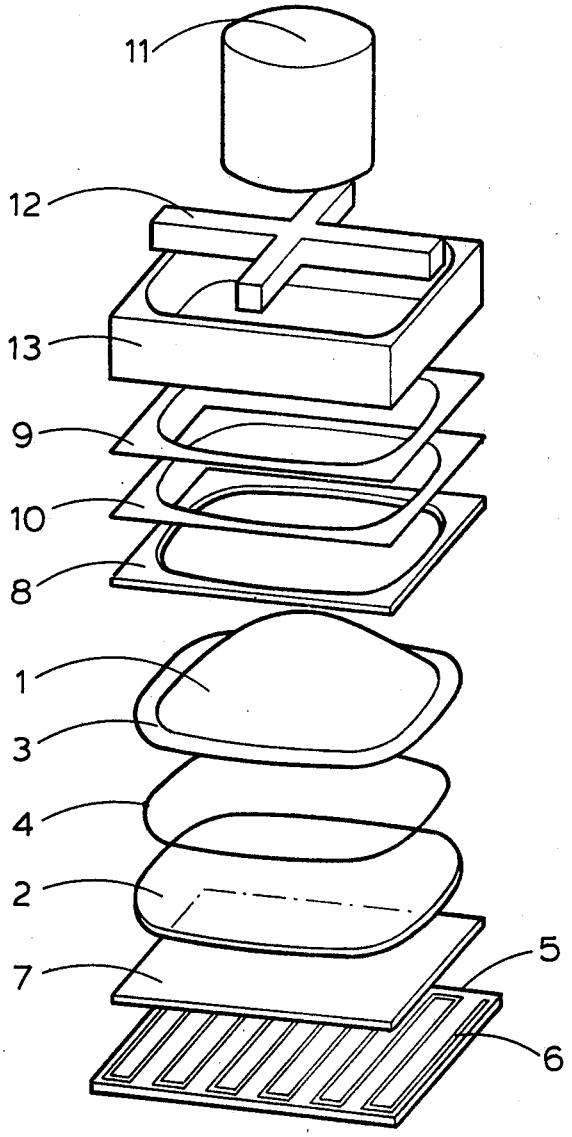
FIG. 1 is an exploded schematic view of a press used to seal a flat glass face-plate to the flange of a metal cone portion of an electron display tube by pressure-bonding.

Referring to FIG. 1, a color television picture tube envelope consists of a mild steel cone portion 1 made by fluid forming from 1 mm thick sheet, and a flat, toughened 6 mm thick glass face-plate 2. The cone portion 1 contains a channel plate intensifier structure, an electron gun structure and other cathode-ray tube components, none of which are shown for the sake of clarity. The cone portion 1 has a 12 mm wide integrally formed flange 3, and defines a rectangular aperture at its open end 280 mm×210 mm, the cone portion 1 being 125 mm high. The face-plate 2 bears a pattern (not shown) of suitable luminescent materials. A length of 2.5 mm diameter 99.99% pure lead wire 4 is placed between opposed areas of the flange 3 and the face-plate 2 so as to form a loop, the ends of the wire 4 being butted together.

Figure 2:
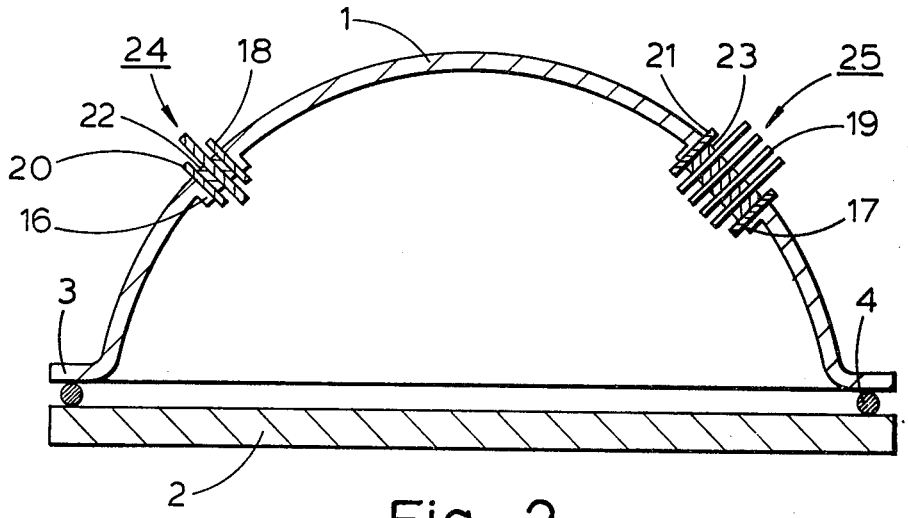
FIG. 2 is a side-sectional elevation of the electron display tube shown in FIG. 1 before pressure has been applied to establish the pressure-bond.

The press shown in FIG. 1 has a fixed base-plate 5 which includes an electric heating element 6, and the face-plate 2 is placed on a pressure plate 7 resting on the base-plate 5. An annular pressure plate 8 rests on the flange 3 of the cone portion 1 and is separated from an annular electrical heater 9 by an annular load-bearing asbestos member 10. FIG. 2 is a side-sectional elevation of the cone portion 1, wire 4 and face-plate 2 before the wire 4 has been deformed in order to make a vacuum-tight seal by pressure-bonding.

Figure 3:
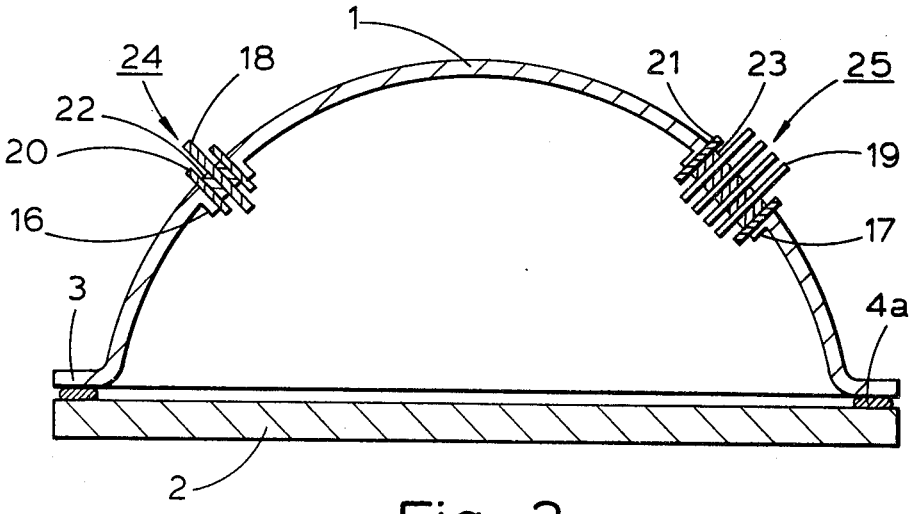
FIG. 3 is a side-sectional elevation of the assembly shown in FIG. 2 after the pressure-bond has been established.

The above-mentioned vacuum-tight seal is made by first heating the face-plate 2, wire 4 and cone portion 1 so that the temperature of the bond zone is 290° C. by energizing the heater 9 and heating element 6. A load of 1750 lbs is then applied to the flange 3 via a ram 11 acting through a load distributor 12 carried on a pressure box 13 supported by the heater 9. The lead wire 4 is partly flattened to form a sealing member 4a (FIG. 3), a vacuum-tight seal being formed between the face-plate 2 and the flange 3, and between the ends of the lead wire 4. Heaters are switched off, and the load is progressively reduced to zero by the time the bond zone temperature has fallen to 250° C.

Figure 4:
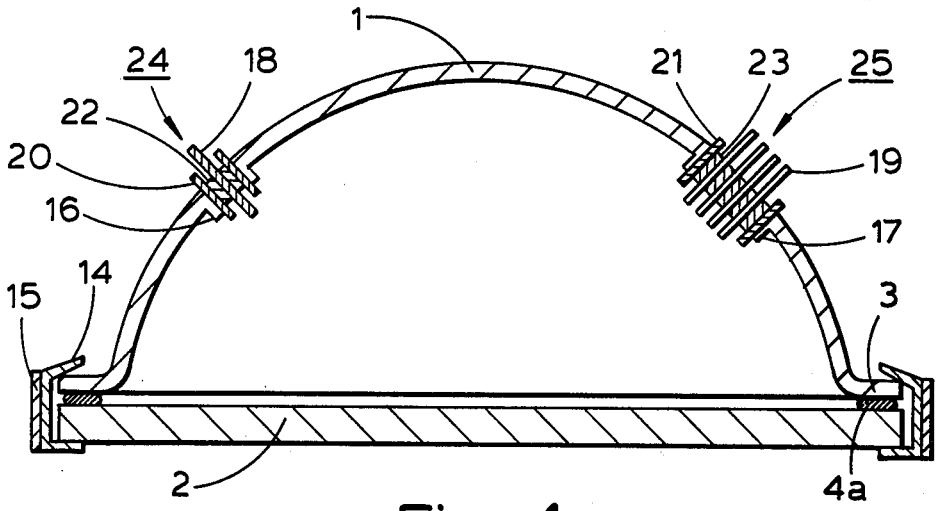
FIG. 4 is a side-sectional elevation of the assembly shown in FIG. 3, after a channel member and a rimband have been fitted.
Figure 5:
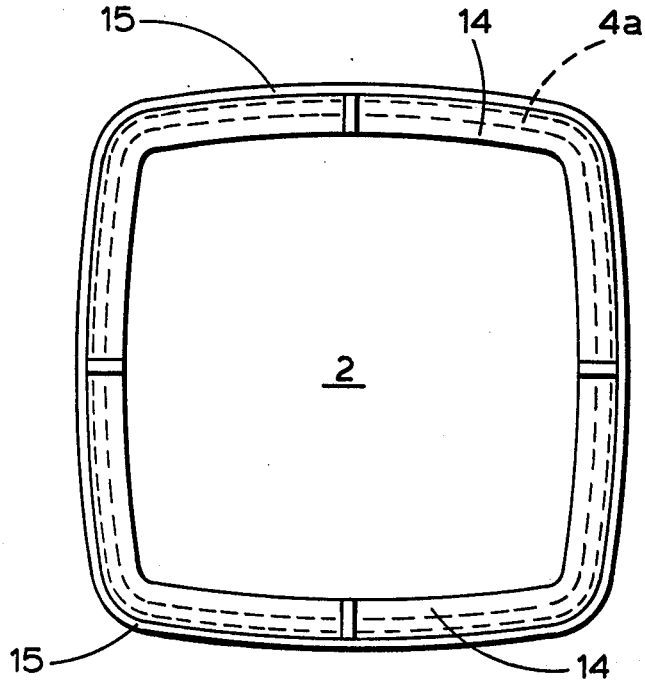
FIG. 5 is a plan view of the assembly shown in FIG. 4.

The assembly is removed from the press and is allowed to cool. Four similar lengths of a substantially U-shaped channel manner 14 are then fitted around the periphery of the face-plate 2 and flange 3 so as to clamp the face-plate 2 to the flange 3 (FIGS. 4 and 5), there being small gaps between adjacent lengths of the channel member 14. The channel member 14 is made of 1 mm thick mild steel and has two asymmetrically disposed limbs which are each 4 mm long. One of these limbs lies along the outside main surface of the face-plate 2, and the other limb diverges by 10° from the edge of the face-plate 2 with respect to the first limb and urges the flange 3 towards the face-plate 2.

An endless stainless steel rimbamd 15 which is 10 mm wide and 1 mm thick is heated by means of an eddy current heating ring to 660° C. so as to expand it sufficiently so as to enable the channel member 14 surrounding the face-plate 2 and flange 3 to pass within the periphery of the rimband 15. The rimband 15 is positioned so as to surround the channel member 14 and is allowed to cool, contracts and tightly embraces the lengths of the channel member 14 which exert a wedging action urging the flange 3 towards the face-plate 2, maintaining the lead sealing member 4a in compression.

The cone portion 1 of the tube includes inwardly extending integrally formed sleeve portions 16 and 17 into which a leadthrough 24 including a getter-firing lead 18 and a multipin leadthrough 25 including circuit connectors 19 respectively are sealed in a vacuum-tight manner. The leadthrough 24 and multipin leadthrough 25 are sealed into sleeves 20 and 21 respectively by means of machinable glass ceramic members 22 and 23 respectively. The sleeves 20 and 21 are sealed into the sleeve portions 16 and 17 respectively by brazing, welding or pressure-bonding. The cone portion 1 also includes a pump stem which is not shown.

It was found that a cathode-ray tube made as described above could withstand a pressure differential of 3 atmospheres. The seal made by the above-described method was satisfactory even after a cathode-ray tube having such a seal had been baked for 48 hours at 260° C. When a cathode-ray tube according to the invention is evacuated, the face-plate deflects, and the cone flange is deflected with the glass around the edge of the face-plate, still keeping the seal in compression.

Since the thermal capacity of the rimband is very small compared with the thermal capacity of the envelope of a cathode-ray tube having a glass cone portion, the quantity of heat required to make a seal in a method according to the invention is very small compared with the quantity of heat required to seal glass portions of a cathode-ray tube envelope together. Furthermore, the heating and cooling cycle of the sealing operation is quite rapid.

The face-plate material and the cone portion material do not have to be matched in respect of their coefficients of thermal expansion, since the pressure-deformable material can accommodate the effects of such a difference. Pressure-deformable materials other than lead may be used, for example, aluminum or a polyimide such as that marketed by Dupont Co. (United Kingdom) Ltd. under the Trade Mark KAPTON.

I claim:

1. An electron display tube comprising a flat, glass face-plate, a metal cone provided with a flange, a metallic pressure-deformable material bonding said flange to said face-plate, the pressure-deformable material having a melting-point of more than 300° C., at least two lengths in combination of a substantially U-shaped metal channel member having asymmetrically disposed limbs extending around substantially the whole periphery of the face-plate and clamping said face-plate and flange, a first limb of said channel member extending along the outside main surface of the face-plate, the second limb of said channel member diverging from the edge of the face-plate with respect to the first limb and urging the flange of the cone portion by means of a wedging action towards the face-plate, and a metal rimband tightly embracing the lengths of the channel member so as to maintain the pressure-deformable material in compression.

2. An electron display tube as claimed in claim 1, wherein the rimband comprises stainless steel.

3. An electron display tube as claimed in claim 1 or claim 2, wherein the rimband is endless.

4. An electron display tube as claimed in claim 1 or 2, wherein the face-plate consists of toughened glass.

5. An electron display tube as claimed in claim 1 or 2, wherein the channel member comprises mild steel.

6. An electron display tube as claimed in claim 1 or 2, wherein the metal cone portion comprises mild steel.

7. An electron display tube as claimed in claim 1 or 2, wherein the pressure-deformable material is a malleable metal having a melting-point in the range from 300° to 700° C.

8. An electron display tube as claimed in claim 7, wherein the malleable metal is lead.

9. An electron display tube as claimed in claim 1 or 2, wherein the face-plate is circular.

10. An electron display tube as claimed in claim 1 or 2, wherein the face-plate is substantially rectangular and there are for lengths of the channel member.

11. An electron display tube as claimed in claim 1 or 2, wherein the cone portion includes inwardly extending integrally formed sleeve portions carrying lead-throughs sealed into the sleeves in a vacuum-tight manner.

12. A method of sealing a flat glass face-plate in a vacuum-tight manner to the flange of a metal cone, the method comprising the steps of locating a loop of a metallic pressure-deformable material between substantially flat opposed surfaces of the face-plate and of the flange, pressing the face-plate and the flange towards each other in a press at a temperature within the range of 200° to 450° C. so as to produce a mechanical bond via the pressure-deformable member which has been deformed by the applied pressure, which temperature is below the melting-point of the pressure-deformable material and below the lowest temperature at which a liquid phase would form during application of the pressure by interaction between the pressure-deformable material and the flange, removing the assembly from the press, fitting at least two lengths of a substantially U-shaped channel member around the periphery of the face-plate and the opposed flange so as to extend around substantially the whole of the said periphery, positioning a metal rimband so as to surround the lengths of the substantially U-shaped channel member, and tightening the rimband so as to tightly embrace the lengths of the channel member and maintain the pressure-deformable material in compression.

* * * * *